US009114913B2

(12) United States Patent
Cole et al.

(10) Patent No.: US 9,114,913 B2
(45) Date of Patent: Aug. 25, 2015

(54) MULTI-COMPARTMENT MICROWAVE HEATING PACKAGE

(75) Inventors: Lorin R. Cole, Larsen, WI (US); Scott W. Middleton, Oshkosh, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 233 days.

(21) Appl. No.: 13/468,276

(22) Filed: May 10, 2012

(65) Prior Publication Data

US 2012/0217237 A1 Aug. 30, 2012

Related U.S. Application Data

(62) Division of application No. 11/823,232, filed on Jun. 27, 2007, now Pat. No. 8,198,571.

(60) Provisional application No. 60/818,591, filed on Jul. 5, 2006.

(51) Int. Cl.

| | |
|---|---|
| ***H05B 6/80*** | (2006.01) |
| ***B65D 5/54*** | (2006.01) |
| ***B65D 81/32*** | (2006.01) |
| ***B65D 30/22*** | (2006.01) |
| ***B65D 81/34*** | (2006.01) |

(Continued)

(52) U.S. Cl.

CPC ..... *B65D 31/12* (2013.01); *B65D 81/3461* (2013.01); *B65D 81/3893* (2013.01); *B65D 75/52* (2013.01); *B65D 2581/3472* (2013.01); *B65D 2581/3474* (2013.01); *B65D 2581/3477* (2013.01); *B65D 2581/3479* (2013.01); *B65D 2581/3494* (2013.01)

(58) Field of Classification Search

CPC .. H01L 21/67115; H05B 6/686; H05B 6/705; H05B 2206/044; Y02B 40/146; Y02B 40/143

USPC ..... 219/725–735, 759; 426/107, 109, 118, 426/234, 241, 243; 99/DIG. 14; 206/219

See application file for complete search history.

(56) References Cited

U.S. PATENT DOCUMENTS 3,145,112 A * 8/1964 Boegershausen ..... 426/121
3,162,539 A * 12/1964 Repko ..... 426/119

(Continued)

FOREIGN PATENT DOCUMENTS

EP 0 365 247 A2 10/1989
GB 2 211 380 A 6/1989

(Continued)

OTHER PUBLICATIONS

International Search Report—PCT/US2007/072312, Jun. 28, 2007, Graphic Packaging International, Inc.

(Continued)

*Primary Examiner* — Quang Van

(74) *Attorney, Agent, or Firm* — Womble Carlyle Sandridge & Rice, LLP

(57) ABSTRACT

A microwave heating construct includes a first compartment and a second compartment joined to one another. The first compartment and the second compartment each include microwave energy interactive material operative for generating heat in response to microwave energy. In a first configuration, the first compartment and the second compartment are side by side, and in a second configuration, the first compartment overlies the second compartment.

7 Claims, 11 Drawing Sheets

(51) Int. Cl.
*B65D 81/38* (2006.01)
*B65D 75/52* (2006.01)

(56) References Cited

U.S. PATENT DOCUMENTS

| | | | | |
|---|---|---|---|---|
| 4,775,771 | A | | 10/1988 | Pawlowski |
| 4,865,921 | A | | 9/1989 | Hollenberg |
| 4,890,439 | A | | 1/1990 | Smart |
| 4,936,935 | A | | 6/1990 | Beckett |
| 4,963,424 | A | | 10/1990 | Beckett |
| 5,034,234 | A | | 7/1991 | Andreas et al. |
| 5,075,119 | A | * | 12/1991 | Mendenhall ..... 426/113 |
| 5,084,601 | A | | 1/1992 | Andreas et al. |
| 5,093,364 | A | | 3/1992 | Richards |
| 5,096,723 | A | | 3/1992 | Turpin |
| 5,117,078 | A | | 5/1992 | Beckett |
| 5,213,902 | A | | 5/1993 | Beckett |
| 5,221,419 | A | | 6/1993 | Beckett |
| 5,260,537 | A | | 11/1993 | Beckett |
| 5,266,386 | A | | 11/1993 | Beckett |
| 5,270,066 | A | | 12/1993 | Pawlowski |
| RE34,683 | E | | 8/1994 | Maynard |
| 5,334,820 | A | | 8/1994 | Risch et al. |
| 5,340,436 | A | | 8/1994 | Beckett |
| 5,354,973 | A | | 10/1994 | Beckett |
| 5,410,135 | A | | 4/1995 | Pollart et al. |
| 5,424,517 | A | | 6/1995 | Habeger, Jr. et al. |
| 5,519,195 | A | | 5/1996 | Keefer et al. |
| 5,585,027 | A | | 12/1996 | Young |
| 5,628,921 | A | | 5/1997 | Beckett |
| 5,672,407 | A | | 9/1997 | Beckett |
| 5,759,422 | A | | 6/1998 | Schmelzer et al. |
| 5,800,724 | A | | 9/1998 | Habeger et al. |
| 5,911,358 | A | | 6/1999 | Kenner et al. |
| 6,114,679 | A | | 9/2000 | Lai |
| 6,150,646 | A | | 11/2000 | Lai et al. |
| 6,204,492 | B1 | | 3/2001 | Zeng et al. |
| 6,251,451 | B1 | | 6/2001 | Zeng |
| 6,414,288 | B1 | | 7/2002 | Bono et al. |
| 6,414,290 | B1 | | 7/2002 | Cole |
| 6,433,322 | B2 | | 8/2002 | Zeng et al. |
| 6,455,827 | B2 | | 9/2002 | Zeng |
| 6,534,755 | B1 | | 3/2003 | Paulucci |
| 6,552,315 | B2 | | 4/2003 | Zeng et al. |
| 6,677,563 | B2 | | 1/2004 | Lai |
| 6,717,121 | B2 | | 4/2004 | Zeng |
| 6,765,182 | B2 | | 7/2004 | Cole |
| 7,019,271 | B2 | | 3/2006 | Wnek |
| 2005/0173425 | A1 | | 8/2005 | Wnek et al. |
| 2005/0205565 | A1 | | 9/2005 | Cole et al. |
| 2006/0049190 | A1 | | 3/2006 | Middleton |
| 2006/0113300 | A1 | | 6/2006 | Wnek |
| 2006/0289521 | A1 | | 12/2006 | Bohme |
| 2008/0006623 | A1 | | 1/2008 | Cole |

FOREIGN PATENT DOCUMENTS

| | | | |
|---|---|---|---|
| JP | 2003-237852 | | 8/2003 |
| WO | WO 93/17532 | A1 | 9/1993 |
| WO | WO 00/35770 | A1 | 6/2000 |
| WO | WO 03/066435 | A2 | 8/2003 |

OTHER PUBLICATIONS

Written Opinion—PCT/US2007/072312, Jun. 28, 2007, Graphic Packaging International, Inc.
Notice of Allowance for U.S. Appl. No. 11/823,232, dated Feb. 21, 2012.

* cited by examiner

MULTI-COMPARTMENT MICROWAVE HEATING PACKAGE

CROSS-REFERENCE TO RELATED APPLICATIONS

This application is a divisional of U.S. patent application Ser. No. 11/823,232, filed Jun. 27, 2007, which claims the benefit of U.S. Provisional Application No. 60/818,591, filed Jul. 5, 2006, both of which are incorporated by reference herein in their entirety.

TECHNICAL FIELD

The present invention relates to various materials, packages, constructs, and systems for heating or cooking a microwavable food item. In particular, the invention relates to various materials, packages, constructs, and systems for heating, browning, and/or crisping a food item in a microwave oven.

BACKGROUND

Microwave ovens provide a convenient means for heating a variety of food items, including many items that ideally are browned and/or crisped, for example, French fries, egg rolls, pizza snacks, and chicken nuggets. However, microwave ovens tend to cook such items unevenly and are unable to achieve the desired balance of thorough heating and a browned, crisp outer surface. Many packages have been devised to improve the browning and/or crisping of such items. Such packages often include one or more microwave energy interactive elements that convert microwave energy to thermal energy to promote browning and/or crisping of the food item. The food item or items generally need to be in proximate or intimate contact with the microwave energy interactive element to achieve the desired level of browning and/or crisping and, as a result, often are heated in a single layer within the package. Unfortunately, since the floor space within the interior of the microwave oven typically is limited, such packages often are restricted to use with a small number of food items. As such, there is a need for improved materials and packages that provide the desired degree of heating, browning, and/or crisping of greater quantities of food items in a microwave oven.

SUMMARY

The present invention is directed generally to various sleeves, pouches, packages, systems, or other constructs (collectively "constructs") for heating browning, and/or crisping one or more food items in a microwave oven, various materials and blanks for forming such constructs, various methods of making such constructs, and methods of heating, browning, and/or crisping one or more food items in a microwave oven.

In one aspect, each of the various constructs of the invention includes a plurality of chambers or compartments into which one or more individual food items may be placed. At least a portion of at least one chamber includes a microwave energy interactive element that enhances or otherwise alters the microwave heating, browning, and/or crisping of the food item or items placed therein. The microwave energy interactive element may be a browning and/or crisping element, a shielding element, or an energy directing element. In some particular examples, the microwave energy interactive element may be a susceptor, a susceptor film, a microwave energy interactive insulating material, or any combination thereof.

In another aspect, at least two of the chambers or compartments are capable of being arranged in a substantially stacked or substantially superposed configuration, thereby reducing the base dimensions or footprint of the package. Thus, the various constructs of the invention are capable of providing a greater microwave interactive surface area for heating, browning, and/or crisping the food item(s) without increasing the footprint of the construct. As a result, a greater number of food items, and/or more than one portion of food items, may be heated, browned, and/or crisped effectively and concurrently in a microwave oven.

In one particular aspect, a construct for heating, browning, and/or crisping a food item in a microwave oven comprises a plurality of compartments, at least one of which is defined at least partially by a microwave energy interactive insulating material. The insulating material includes a layer of microwave energy interactive material supported on a first polymer film layer, and a second polymer film layer that at least partially defines a plurality of expandable insulating cells that inflate upon exposure to microwave energy.

In one variation, the microwave energy interactive insulating material further includes a moisture-containing layer superposed with the microwave energy interactive material, and the second polymer film layer is joined to the moisture-containing layer in a predetermined pattern, thereby defining the plurality of expandable insulating cells between the moisture-containing layer and the second polymer film layer. In another variation, the second polymer film layer is joined to the layer of microwave energy interactive material in a predetermined pattern that defines the plurality of expandable insulating cells, and the microwave energy interactive insulating material further includes a gas-generating reagent disposed between the layer of microwave energy interactive material and the second polymer film layer.

In another variation, a first compartment of the plurality of compartments has an interior surface defined at least partially by the first polymer film layer, and a second compartment of the plurality of compartments has an interior surface defined at least partially by the first polymer film layer and at least partially by the second polymer film layer. In still another variation, the first compartment and the second compartment each have an interior surface defined at least partially by the first polymer film layer.

The plurality of compartments may be defined by one or more pieces or sheets of microwave energy interactive insulating material.

In one example, the compartments are defined by a single sheet of microwave energy interactive insulating material, and the sheet comprises a first section, a second section, and a third section, each having substantially equal dimensions, with the second section being disposed between the first section and the third section. The first section and the second section at least partially define a first compartment, and the first section and the third section at least partially define a second compartment.

The first section, second section, and third section may be joined along at least one respective edge. In one example, the first section, second section, and third section each include a pair of opposed end edges, and are joined along at least one respective end edge of the pair of opposed end edges. In another example, the first section is joined to the second section along a first side edge of the first section, and the third section is joined to the first section along a second side edge of the first section opposite the first side edge of the first section.

In one variation, the sheet of insulating material has a first side comprising the first polymer film layer and a second side comprising the second polymer film layer, a first compartment has an interior surface defined substantially by the first polymer film layer, and a second compartment has an interior surface defined partially by the first polymer film layer and partially by the second polymer film layer. Such a construct may be formed by defining a first section, a second section, and a third section of the sheet, each being substantially equal in size, folding the first section over the second section to form the first compartment, folding the third section over the first section to form the second compartment, and joining the first section, second section, and the third section along at least one respective edge.

In another example, the plurality of compartments are defined by a single sheet of microwave energy interactive insulating material, and the sheet comprises a first section, a second section, a third section, and a fourth section, each being substantially equal in dimension. The second section is disposed between the first section and the third section, and the third section is disposed between the second section and the fourth section. The first section and the second section at least partially define a first compartment, and the third section and the fourth section at least partially define a second compartment.

The various sections may be joined in any suitable manner. In one example, the first section is joined to the second section along at least one respective edge, and the third section is joined to the fourth section along at least one respective edge. In another example, the first section, second section, third section, and fourth section each include a pair of opposed end edges, the first section and second section are joined along at least one respective end edge of the pair of opposed end edges, and the third section, and fourth section are joined along at least one respective end edge of the pair of opposed end edges. In still another example, the first section is joined to the second section along an edge of the second section adjacent the third section, and the fourth section is joined to the third section along an edge of the third section adjacent the second section.

In one variation of this example, the sheet of insulating material has a first side comprising the first polymer film layer and a second side comprising the second polymer film layer, and a first compartment and a second compartment each have an interior surface defined substantially by the first polymer film layer. Such a construct may be formed by defining a first section, a second section, a third section, and a fourth section of the sheet, each being substantially equal in size, folding the first section over the second section to define the first compartment, folding the fourth section over the third section to define the second compartment, joining the first section to the second section, and joining the fourth section to the third section.

Other aspects, features, and advantages of the present invention will become apparent from the following description and accompanying figures.

BRIEF DESCRIPTION OF THE FIGURES

The description refers to the accompanying drawings, some of which are schematic, in which like reference characters refer to like parts throughout the several views, and in which.

DESCRIPTION

The present invention may be illustrated with reference to the figures. For purposes of simplicity, like numerals may be used to describe like features. It will be understood that where a plurality of similar features are depicted, not all of such features are necessarily labeled on each figure. While various examples are shown and described in detail herein, it also will be understood that any of the various features may be used with any construct described herein or contemplated hereby, in any combination.

Figure 1A:
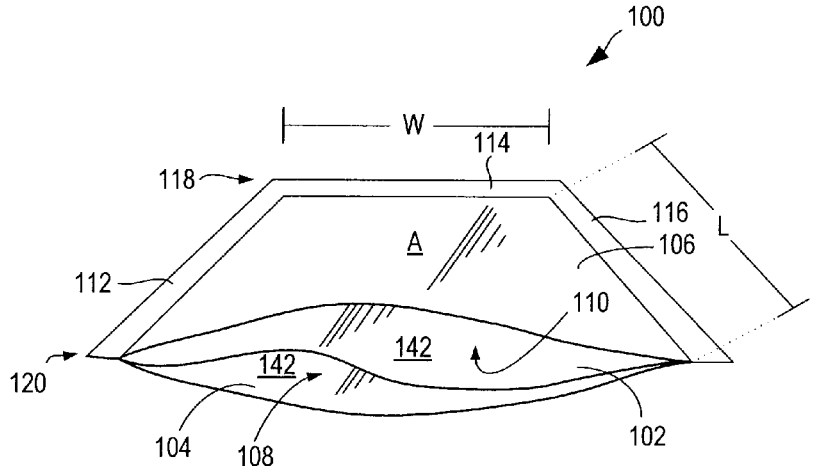
FIG. 1A schematically depicts an exemplary construct according to various aspects of the present invention, including a first and second compartment in a stacked configuration.
Figure 1B:
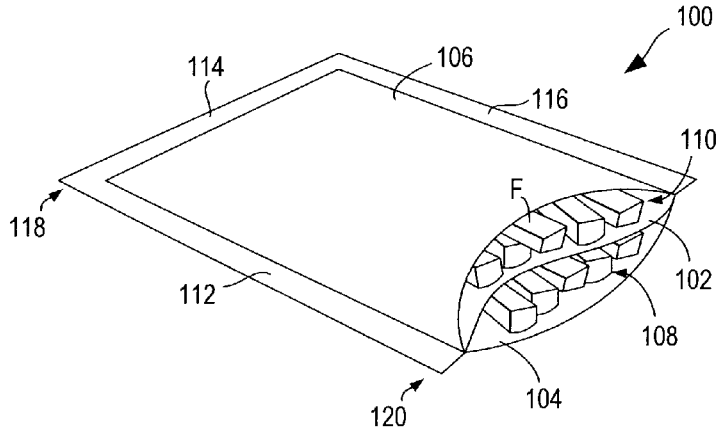
FIG. 1B schematically depicts the construct of FIG. 1A with food items within the first compartment and the second compartment.

FIGS. 1A and 1B illustrate an exemplary construct according to various aspects of the invention. In this example, the construct comprises a pouch 100 formed from a plurality of panels 102, 104, 106 that define a first chamber or compartment 108 and a second chamber or compartment 110 for receiving one or more food items F therein (FIG. 1B). More particularly, panels 102 and 104 at least partially define compartment 108, and panels 102 and 106 at least partially define compartment 110. In this example, the various panels 102, 104, 106 are at least partially joined, and in some examples, substantially joined or completely joined, along respective peripheral areas 112, 114, and 116 to form a somewhat rectangular pouch 100 having a closed end 118 and an open end 120. However, it will be understood that the construct may have any shape, any number of compartments, and any construction as needed or desired for a particular application. Thus, for example, while the pouch shown in FIGS. 1A and 1B includes two compartments or chambers, various other constructs may include three, four, five, six, or any other number of compartments.

Figure 1C:
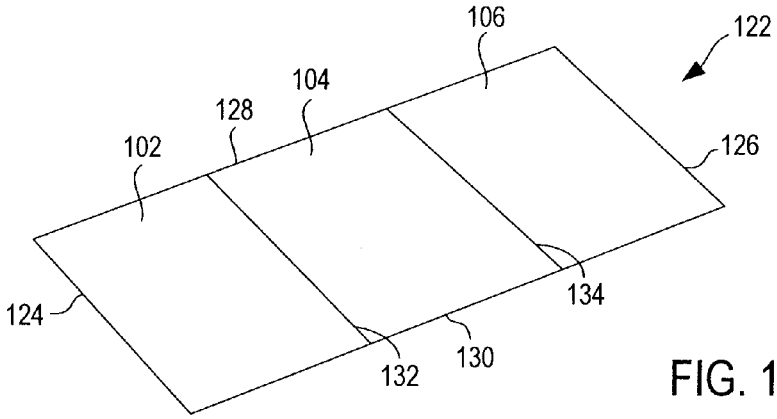
FIG. 1C schematically depicts an exemplary sheet having a plurality of panels that may be used to form the construct of FIGS. 1A and 1B.
Figure 1D:
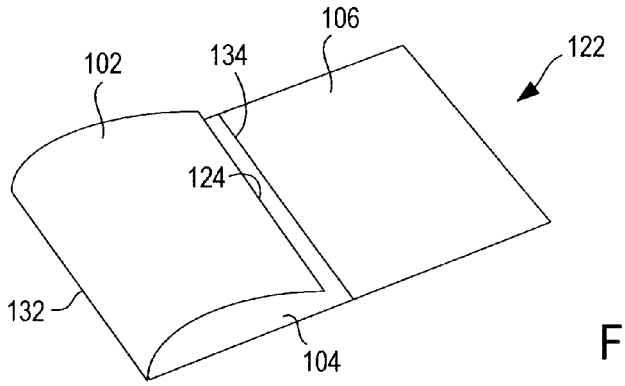
FIG. 1D schematically depicts the sheet of FIG. 1C in a partially folded configuration.
Figure 1E:
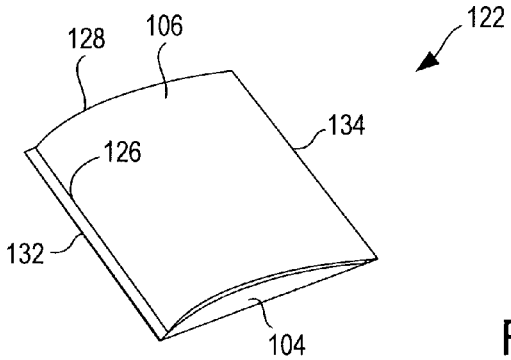
FIG. 1E schematically depicts the sheet of FIG. 1C in a substantially folded configuration.

The construct 100 of FIGS. 1A and 1B may be formed using any suitable process or technique including various sequences of steps. By way of example, and not limitation, the pouch 100 may be formed from a single, substantially continuous, planar sheet 122 including a first section, segment, portion, or panel 102, a second section, segment, portion, or panel 104, and a third section, segment, portion, or panel 106 defined by edges 124, 126, 128, 130 and creases, fold lines, or other lines of weakening 132, 134, as shown in FIG. 1C. The creases 132, 134 are positioned such that each of the first panel 102, second panel 104, and third panel 106 are approximately equal in size. As shown in FIG. 1D, the first panel 102 may be folded inwardly along crease 132 until edge 124 is aligned substantially with crease 134. As shown in FIG. 1E, the third panel 106 then may be folded inwardly along crease 134 until edge 126 is aligned substantially with crease 132. In this arrangement, the first panel 102, second panel 104, and third panel 106 are substantially superposed.

If desired, a thermal, adhesive, ultrasonic, or other type of bond may be formed along or proximate to respective creases 132, 134 to secure the various panels into their respective positions and to provide dimensional stability along peripheral areas 112, 116 of the resulting construct 100, as shown in FIGS. 1A and 1B. Furthermore, if desired, a thermal, adhesive, ultrasonic, or other type of bond also may be formed along or proximate to edge 128 to form pouch 100, for example, as shown with peripheral area 114 in FIGS. 1A and 1B. If the pouch 100 is intended to serve as a container for the food items prior to heating, the open end 120 of the pouch 100 also may be sealed or otherwise closed (not shown) after the food items are placed inside.

In this and other aspects of the invention, numerous other methods of forming the pouch are contemplated. For example, the pouch may be formed from a three panel sheet folded in alternating directions, resembling an accordion. As another example, the pouch may be formed from two sheets, each forming all or a portion of a panel. In one particular example, a first sheet may be folded in half to form a first compartment and a second sheet may be joined to the first sheet to form a second compartment. As still another example, the pouch may be formed from three sheets or panels, joined to one another along at least a portion of respective edges. Still other possibilities are contemplated.

Various materials or structures may be used to form a sheet or panel used in the construct of the invention. For example, at least a portion of the pouch 100 may include or may be formed from one or more microwave energy interactive elements. In one particular example, at least a portion of the construct is formed from a microwave energy interactive insulating material. As used herein, the term "microwave energy interactive insulating material" (or "microwave interactive insulating material", "insulating material", "microwave energy interactive insulating structure", or "insulating structure") refers any combination of layers of materials that is responsive to microwave energy and is capable of providing some degree of thermal insulation when used to heat a food item. Such insulating materials alter the effect of microwave energy to enhance the heating, browning, and/or crisping of an adjacent food item, and also provide thermal insulation to prevent loss of thermal energy to the ambient heating environment.

Figure 1F:
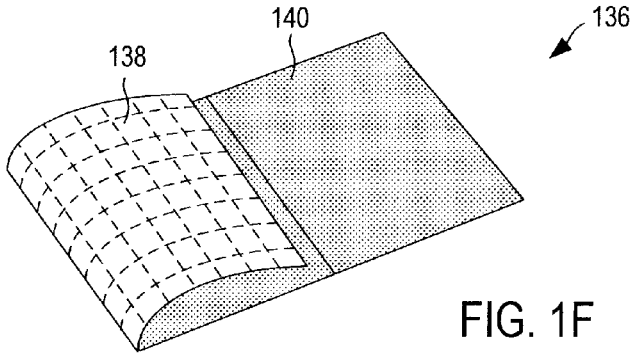
FIG. 1F schematically depicts the sheet of FIG. 1C formed from a microwave energy interactive insulating material, in a partially folded configuration, similar to that of FIG. 1D.

As illustrated schematically in FIG. 1F, the pouch 100 of FIGS. 1A and 1B may be formed at least partially from a sheet of insulating material 136 including a plurality of cells 138 (sometimes referred to as "expandable cells", "insulating cells", or "expandable insulating cells", shown schematically with dashed lines in FIG. 1F) that are capable of expanding when the pouch 100 is exposed to microwave energy. The insulating material 136 also includes a susceptor film 140 (shown schematically by stippling in FIG. 1F) that forms at least one side of the sheet 136 and, therefore, at least a portion of the interior surface 142 of at least one compartment 108, 110 of the construct 100. More particularly, in this example, the susceptor film 140 defines the upper portion of the interior surface 142 of compartment 110 (i.e., the interior face of panel 106) and the upper and lower portions of the interior surface 142 of compartment 108 (i.e., the interior face of each of panels 102 and 104). It will be understood that use of the terms "upper" and "lower" is merely for ease of description with reference to the drawings, and is not intended to be limiting in any manner. The susceptor film 140 comprises a thin layer of microwave interactive material supported on a polymer film. The microwave energy interactive material tends to absorb microwave energy, thereby generating heat at the interface with a food item. Such elements often are used to promote browning and/or crisping of the surface of a food item (sometimes referred to as a "browning and/or crisping element").

Figure 1G:
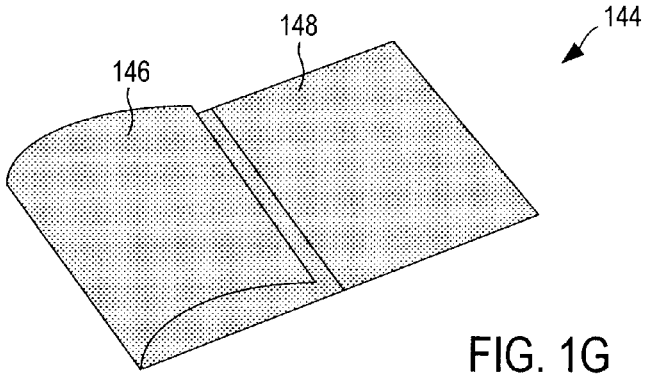
FIG. 1G schematically depicts another exemplary sheet having a plurality of panels that may be used to form the construct of FIGS. 1A and 1B.
Figure 1H:
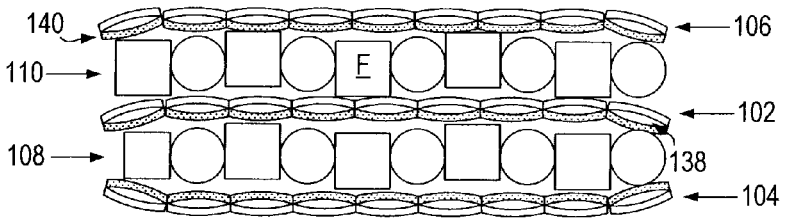
FIG. 1H schematically depicts the construct of FIGS. 1A and 1B formed from the sheet of FIG. 1F, upon exposure to microwave energy.

Several specific examples of insulating materials are described herein with reference to FIGS. 3A-6B. However, other insulating materials are contemplated hereby. Additionally, it is understood that numerous other types of materials may be used to form a construct according to the invention, including, but not limited to, susceptors and susceptor films without insulating cells. For example, some of such materials, for example, material 144, may include opposed sides 146, 148 or surfaces formed from susceptor films, as illustrated schematically in FIG. 1G, such that the interior surface and exterior surface of each chamber of the resulting construct (not shown) is formed at least partially from a susceptor film. Thus, in various examples, the construct may comprise a susceptor, a microwave energy interactive insulating material, a multi-layer susceptor material, a multi-layer microwave energy interactive insulating material, any other microwave energy interactive element, or any combination thereof.

Returning to FIGS. 1A and 1B, to use the pouch 100 according to one exemplary method, one or more food items F, which may be the same type or may include different types, may be inserted through the open end 120 into the compartments 108, 110 of the pouch 100. Alternatively, the pouch 100 may be provided with the food items F inside. In the example shown in FIG. 1B, a plurality of French fries F are seated within both compartments 108, 110. If desired, the French fries F may be positioned substantially in a single layer to increase the amount of intimate or proximate contact with the susceptor film that forms at least a portion of the interior surface 142 of the compartments 108, 110.

The pouch 100 then may be placed into a microwave oven (not shown) and seated on an outer face of one of the outer panels, in this example, outer panel 104, such that compartment 110 overlies compartment 108 in a superposed relation. In this configuration, the French fries F in compartment 108 are seated on the interior face of outer panel 104, and the French fries F in compartment 110 are seated on the side of the dividing panel 102 that faces compartment 110.

When the construct 100 is exposed to microwave energy, the microwave interactive material in the susceptor film 140 heats and causes the insulating cells 138 to expand, as shown schematically in FIG. 111 (in cross-sectional view), and as will be discussed further with reference to FIGS. 3A-6B. In doing so, the susceptor film 140 (schematically illustrated by stippling) bulges away from the inflated cells 138. In compartment 108, the susceptor film 140 defines the upper and lower interior surface, each of which bulges towards the food item F (illustrated schematically with squares and circles). In contrast, since the susceptor film 140 defines only the upper interior surface of compartment 110, the susceptor film 140 will bulge towards the top surface of the food item F. In either case, bringing the susceptor film 140 into closer proximity to the food item enhances the browning and/or crisping of the surface of the French fries F. Furthermore, the expanded insulating cells 138 may reduce the loss of thermal energy to the ambient heating environment, which also may enhance heating, browning, and/or crisping of the food item F. After heating, the French fries F may be consumed directly from the pouch 100 or may be removed prior to consumption.

It will be understood that in this and other aspects of the invention, by providing a plurality of substantially superposed chambers or compartments, a greater quantity of food items may be heated, browned, and/or crisped concurrently. Stated otherwise, the various constructs of the invention increase the effective surface area available for heating, browning, and/or crisping a plurality of food items. For example, considering the pouch of FIG. 1A, and assuming that each of the outer panels and the dividing panel has substantially the same unbonded length L and width W, and therefore footprint or area A, the total interior surface area available for contact with the food item is about four times A, or about 4 A. More particularly, using the material 136 of FIG. 1F, the total interior surface area of susceptor film 140 is about three times A, or about 3 A. In contrast, a single compartment package (not shown) having the same footprint or base area, A, would have a total interior surface area of about two times A, or 2 A, available for contact with the food item. While it is conceivable that the same quantity of French fries or other food items could fit into a single compartment construct, such items would not likely be heated, browned, and/or crisped as effectively. Where a three compartment construct having the same base area or footprint is used, the available contact area may be as much as about six times A, or about 6 A, and so on. Thus, according to the invention, a quantity of food items can be heated, browned, and/or crisped both concurrently and more effectively.

Figure 2A:
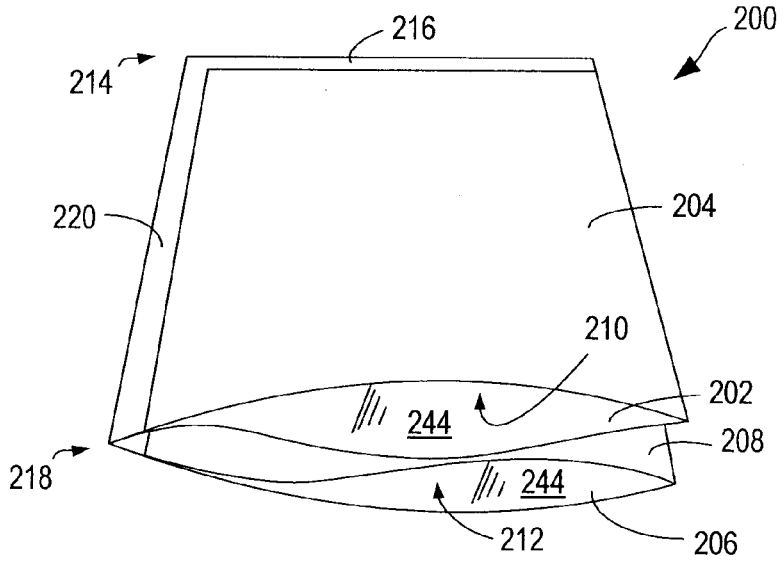
FIG. 2A schematically depicts another exemplary construct according to various aspects of the present invention, including a first and second compartment in a stacked configuration.
Figure 2B:
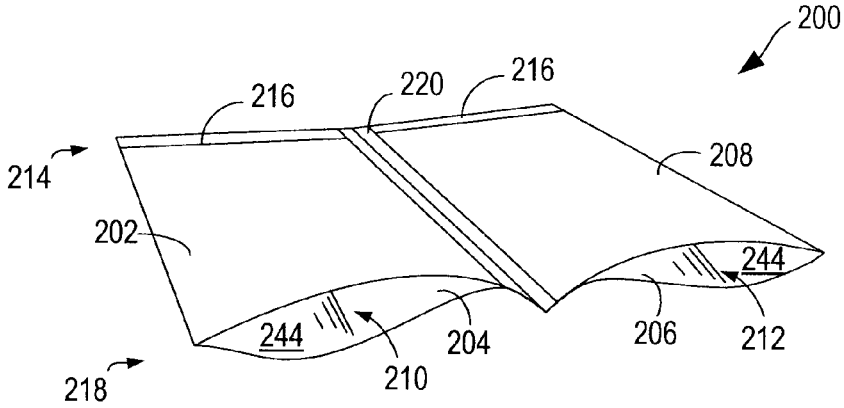
FIG. 2B schematically depicts the construct of FIG. 1B in an unstacked, open, side-by-side configuration.

FIGS. 2A and 2B depict another exemplary construct according to various aspects of the invention. In this example, the construct comprises a pouch 200 formed from a plurality of panels 202, 204, 206, 208 that define chambers or compartments 210, 212 for receiving one or more food items. More particularly, panels 202, 204 at least partially define compartment 210, and panels 206, 208 at least partially define compartment 212. The compartments 210, 212 each have a first, closed end 214 defined by adjoined peripheral areas 216, and a second, open end 218. The compartments 210, 212 are joined hingedly along peripheral region 220 and are capable of being arranged in a substantially stacked or superposed configuration, as shown in FIG. 2A, or in a substantially open configuration, as shown in FIG. 2B.

Figure 2C:
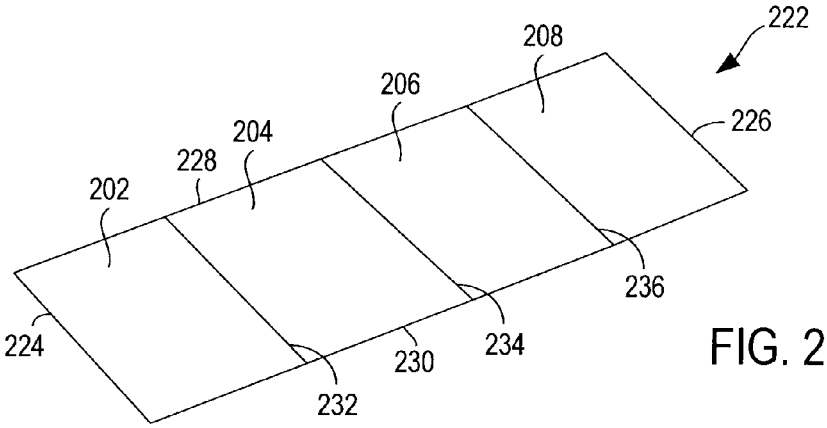
FIG. 2C schematically depicts an exemplary sheet having a plurality of panels that may be used to form the construct of FIG. 2A.
Figure 2D:
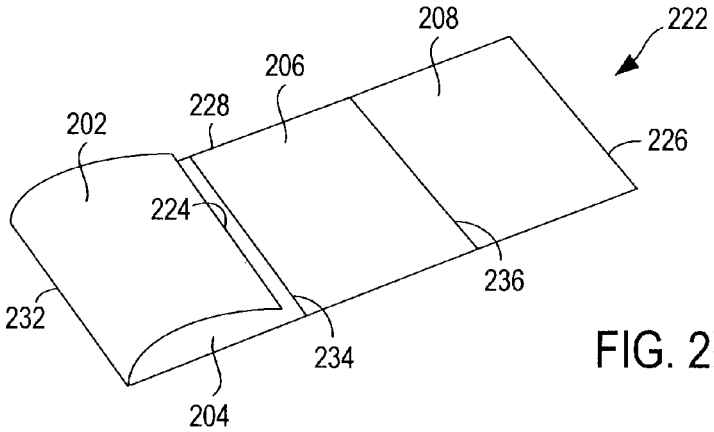
FIG. 2D schematically depicts the sheet of FIG. 2C in a partially folded configuration.
Figure 2E:
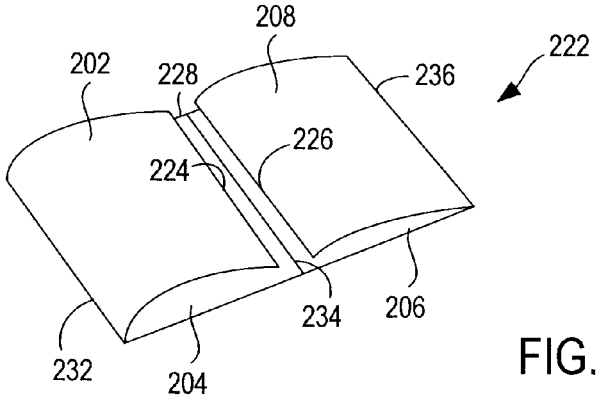
FIG. 2E schematically depicts the sheet of FIG. 2C in a substantially folded configuration.

The construct 200 of FIGS. 2A and 2B may be formed using any suitable process or technique including various sequences of steps. According to one exemplary method, the pouch 200 may be formed from a single sheet 222 (FIG. 2C) including a first section, segment, portion, or panel 202, a second section, segment, portion, or panel 204, a third section, segment, portion, or panel 206, and a fourth section, segment, portion, or panel 208 collectively defined by edges 224, 226, 228, 230 and creases or fold lines 232, 234, 236. The creases 232, 234, 236, may be positioned such that panels 202, 204, 208, 210 are each approximately equal in size. As shown in FIG. 2D, the first panel 202 may be folded inwardly along crease 232 until edge 224 is aligned substantially with or proximate to crease 234. Likewise, as shown in FIG. 2E, the fourth panel 208 then may be folded inwardly along crease 236 until edge 226 is aligned substantially with or proximate to crease 234. In this arrangement, the first panel 202 and second panel 204 are superposed substantially, and the third panel 206 and the fourth panel 208 are superposed substantially. If desired, one or more thermal, adhesive, ultrasonic or other type of bond areas or lines may be formed along or adjacent crease 234 to secure the various panels in their respective positions and to provide dimensional stability to the resulting construct 200, for example, bond area 220 in FIGS. 2A and 2B. Furthermore, if desired, a thermal, adhesive, ultrasonic, or other type of bond also may be formed along or proximate edge 228 to form pouch 200, for example, bond area 216 in FIGS. 2A and 2B. If desired, the compartments 210, 212 may be adjoined in a stacked configuration along creases 232, 236 (not shown). Further, if the pouch 200 is intended to serve as a container for the food items prior to heating, the open end 218 of the pouch also may be sealed (not shown) after the food items are inserted into the pouch. Numerous other methods for forming the pouch from one, two, three, or four sheets are contemplated hereby.

At least a portion of the pouch 200 may include or may be formed from one or more microwave energy interactive elements. For example, as illustrated schematically in FIG. 2F, the pouch 200 of FIGS. 2A and 2B may be formed at least partially from a somewhat flexible, microwave energy interactive insulating material 238 including a plurality of insulating cells 240 (shown schematically in FIG. 2F with dashed lines) that expand upon exposure to microwave energy. The insulating material 238 also includes a susceptor film 242 (shown schematically in FIG. 2F by stippling) that forms at least a portion of the interior surface 244 of at least one compartment 210, 212. Examples of such materials are described with reference to FIGS. 3A-6B. However, numerous other materials may be used.

To use the pouch 200 according to one exemplary method, one or more of food items (not shown) may be inserted into the pouch 200 through the open end 218 or may be provided in the pouch 200. The compartments 210, 212 may be arranged in a substantially stacked configuration, as shown in FIG. 2A, and placed into a microwave oven, although it is contemplated that the food items may be heated with the pouch 200 in an opened, unstacked configuration, as shown in FIG. 2B. In the example shown in FIG. 2A, compartment 210 overlies compartment 212. However, compartment 212 may overlie 210 if desired.

In any configuration, when the pouch 200 is exposed to microwave energy, the microwave energy interactive material in the susceptor film 242 heats and causes the insulating cells 240 to inflate (not shown). In doing so, the susceptor film 242 that forms at least a portion of the interior surface 244 of the compartments 210, 212 may bulge toward the food item, thereby enhancing the heating, browning, and/or crisping of the food item therein. After heating, the food item may be consumed from the pouch or may be removed prior to consumption.

FIGS. 3A-6B illustrate various examples of microwave energy interactive materials that may be suitable for use with the present invention. The various insulating materials may include multiple layers or components, including both microwave energy responsive or interactive elements or components and microwave energy transparent or inactive elements or components, provided that each is resistant to softening, scorching, combusting, or degrading at typical microwave oven heating temperatures, for example, at from about 250° F. to about 425° F. The insulating material may include both microwave energy responsive or interactive components, and microwave energy transparent or inactive components.

Figure 2F:
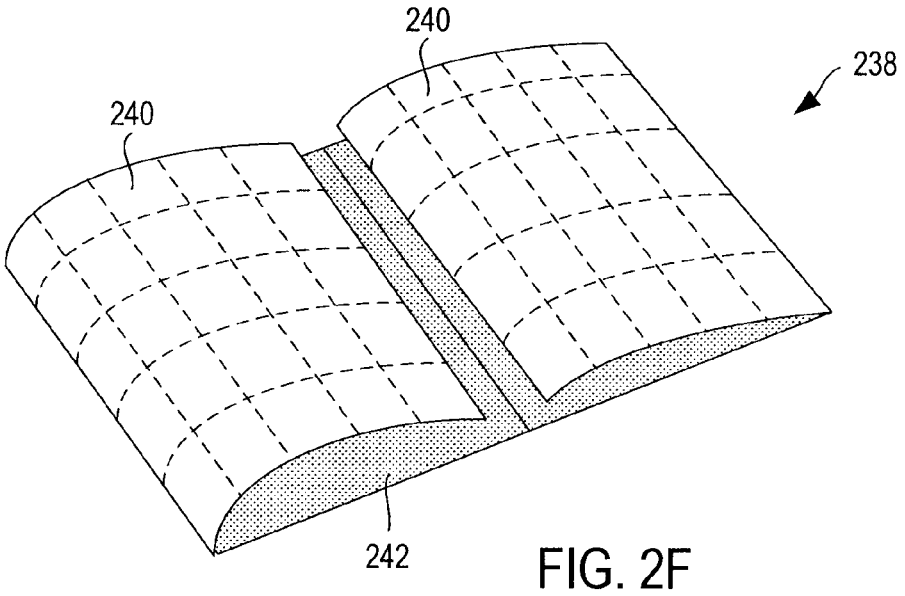
FIG. 2F schematically depicts the sheet FIG. 2C formed from a microwave energy interactive insulating material, in a substantially folded configuration, similar to that of FIG. 2E.

In one aspect, the insulating material comprises one or more susceptor layers in combination with one or more expandable insulating cells, as discussed particularly in connection with FIGS. 1F and 2F. Such materials sometimes may be referred to herein as "expandable cell insulating materials". Additionally, the insulating material may include one or more microwave energy transparent or inactive materials to provide dimensional stability, to improve ease of handling the microwave energy interactive material, and/or to prevent contact between the microwave energy interactive material and the food item.

In another aspect, the insulating material may comprise of microwave energy interactive material supported on a first polymer film layer, a moisture-containing layer superposed with the microwave energy interactive material, and a second polymer film layer joined to the moisture-containing layer in a predetermined pattern using an adhesive, chemical or thermal bonding, or other fastening agent or process, thereby forming one or more closed cells between the moisture-containing layer and the second polymer film layer. The microwave energy interactive material may serve as a susceptor. The closed cells expand or inflate in response to being exposed to microwave energy and cause the susceptor to bulge and deform toward the food item.

While not wishing to be bound by theory, it is believed that the heat generated by the susceptor causes moisture in the moisture-containing layer to evaporate, thereby exerting pressure on the adjacent layers. As a result, the expandable cells bulge outwardly away from the expanding gas, thereby allowing the expandable cell insulating material to conform more closely to the contours of the surface of the food item. As a result, the heating, browning, and/or crisping of the food item can be enhanced, even if the surface of the food item is somewhat irregular.

Further, the water vapor, air, and other gases contained in the closed cells provide insulation between the food item and the ambient environment of the microwave oven, thereby increasing the amount of sensible heat that stays within or is transferred to the food item. Such insulating materials also may help to retain moisture in the food item when cooking in the microwave oven, thereby improving the texture and flavor of the food item. Additional benefits and aspects of such materials are described in PCT Publication No. WO 2003/66435, U.S. Pat. No. 7,019,271, and U.S. Patent Application Publication No. 2006/0113300 A1, each of which is incorporated by reference herein in its entirety.

Several exemplary insulating materials are depicted in FIGS. 3A-6B. As discussed above, the various panels, for example, panels 102, 104, 106, 202, 204, 208, 210, that form the constructs of the invention, for example, constructs 100, 200, may comprise, may consist essentially of, or may consist of such structures. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers. Furthermore, it is noted that, for purposes of simplicity, and not limitation, the predetermined pattern of adhesion, bonding, or fastening may be generally referred to herein as "lines of adhesion" or a "pattern of adhesion" or a "patterned adhesive". However, it will be understood that there are numerous methods of forming the closed cells, and that such methods are contemplated hereby.

Figure 3A:
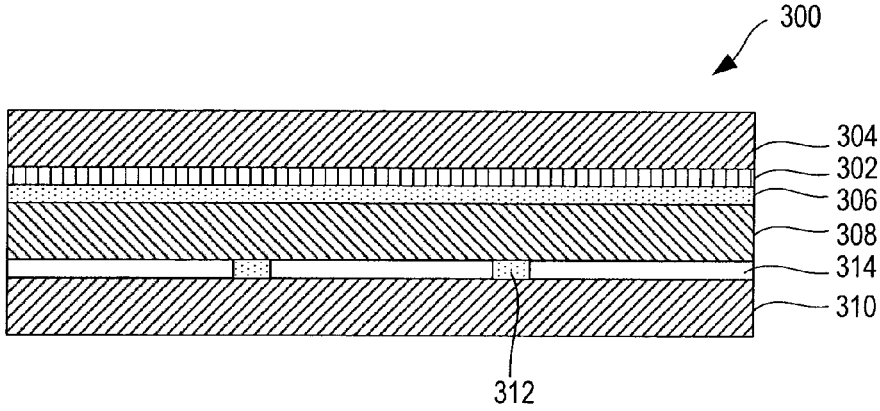
FIG. 3A is a schematic cross-sectional view of an exemplary microwave energy interactive insulating material that may be used to form a construct in accordance with various aspects of the present invention.
Figure 3B:
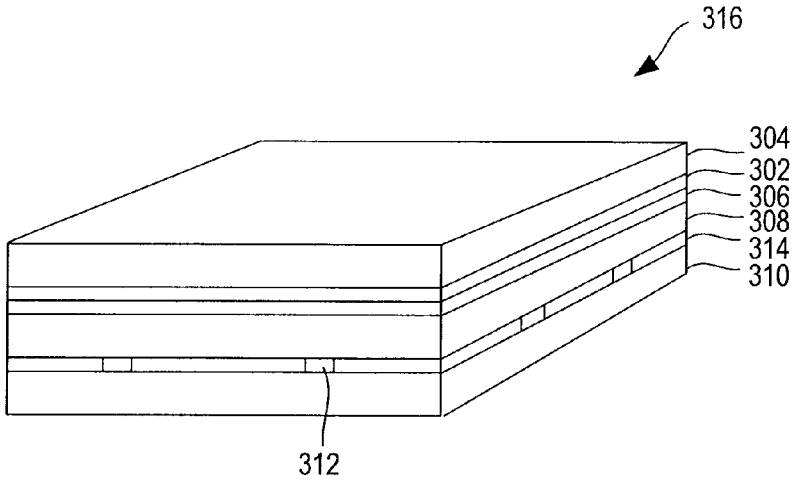
FIG. 3B schematically depicts the exemplary microwave energy interactive insulating material of FIG. 3A, in the form of a cut sheet.

FIG. 3A depicts an exemplary microwave energy interactive insulating material 300 that may be suitable for use in forming all or a portion of a construct according to the invention. In this example, a thin layer of microwave energy interactive material 302 that serves as a susceptor is supported on a first polymer film 304 (collectively forming a "susceptor film") and bonded by lamination with an adhesive 306 (or otherwise) to a dimensionally stable substrate 308, for example, paper. The substrate 308 is bonded to a second polymer film 310 using a patterned adhesive 312 or other material, thereby forming a plurality of expandable insulating cells 314. The insulating material 300 may be cut and provided as a substantially flat, multi-layered sheet 316, as shown in FIG. 3B.

Figure 3C:
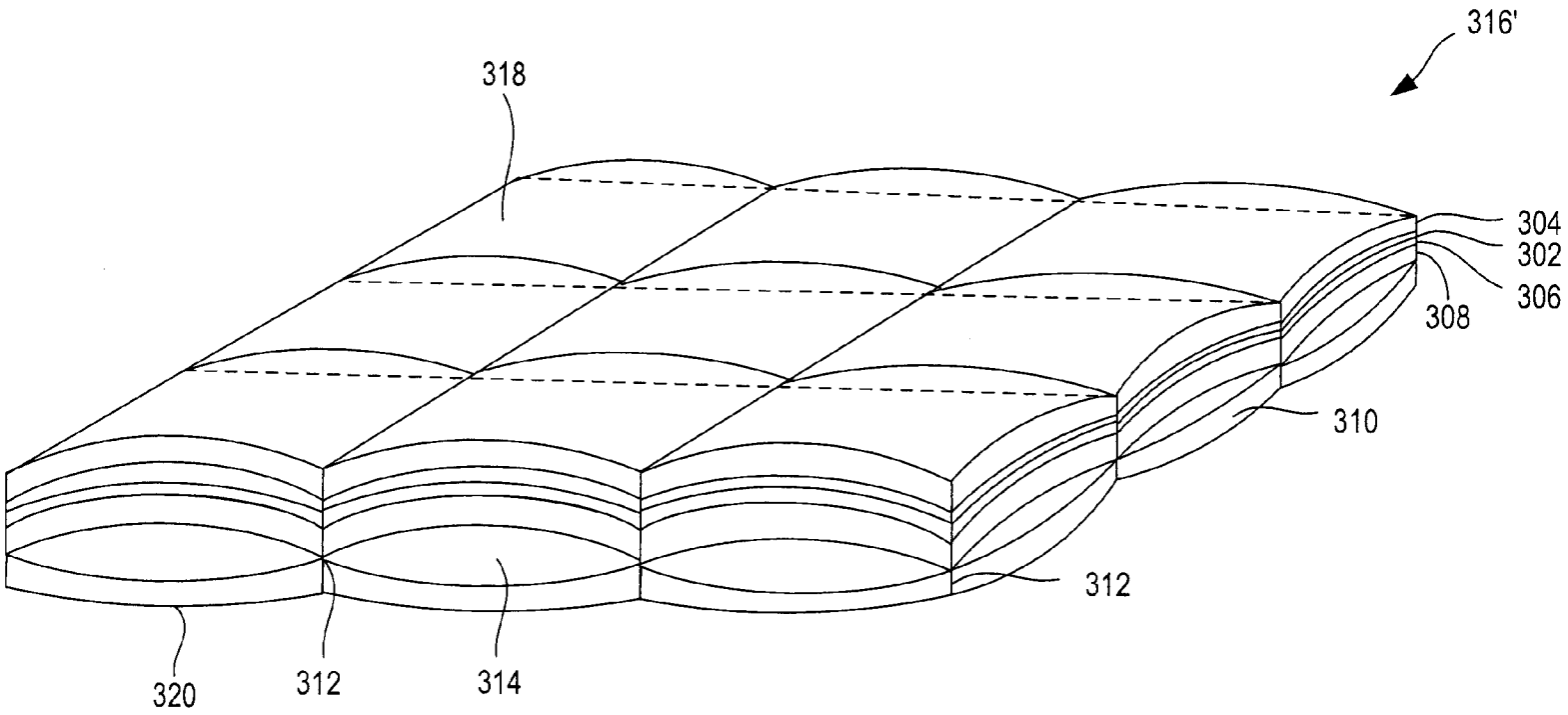
FIG. 3C schematically depicts the exemplary microwave energy interactive insulating sheet of FIG. 3B, upon exposure to microwave energy.

As the layer microwave energy interactive material 302 (i.e., the susceptor) heats upon impingement by microwave energy, water vapor and other gases typically held in the substrate 308, for example, paper, and any air trapped in the thin space between the second polymer film 310 and the substrate 308 in the closed cells 314, expand, as shown in FIG. 3C. The resulting insulating material 316' has a quilted or pillowed or lofted top surface 318 and bottom surface 320. When microwave heating has ceased, the cells 314 typically deflate and return to a somewhat flattened state.

Figure 3D:
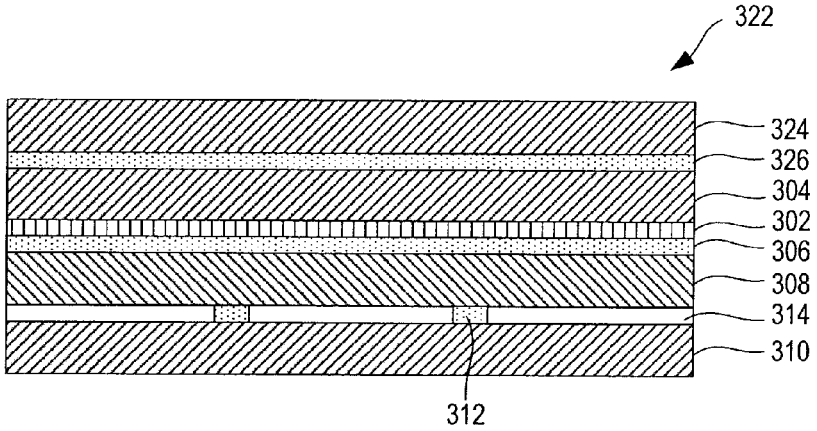
FIG. 3D is a schematic cross-sectional view of an exemplary variation of the exemplary microwave energy interactive insulating material of FIG. 3A.

If desired, the insulating material 300 may be modified to form a structure 322 that includes an additional paper or polymer film layer 324 joined to the first polymer film layer 304 using an adhesive 326 or other suitable material, as shown in FIG. 3D.

Figure 4:
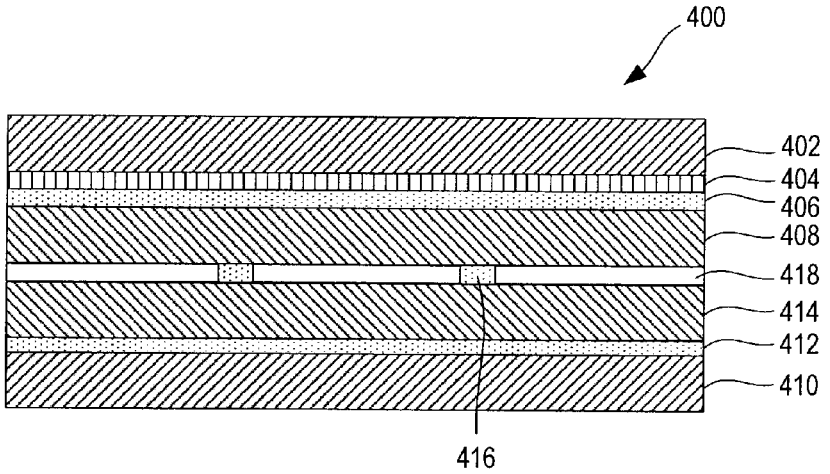
FIG. 4 depicts a schematic cross-sectional view of another exemplary microwave energy interactive insulating material that may be used to form a construct in accordance with various aspects of the present invention.

FIG. 4 illustrates another exemplary insulating material 400. The material 400 includes a polymer film layer 402, a susceptor layer 404, an adhesive layer 406, and a paper layer 408. Additionally, the material 400 may include a second polymer film layer 410, an adhesive 412, and a paper layer 414. The layers may be adhered or affixed by a patterned adhesive 416 that defines a plurality of closed expandable cells 418.

Figure 5:
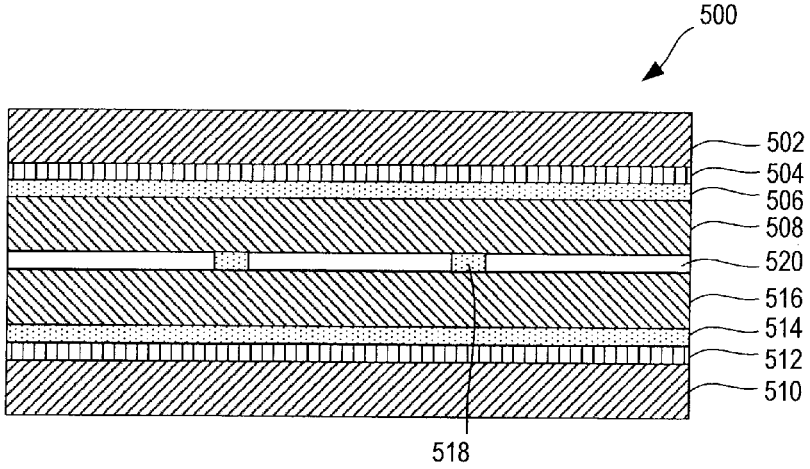
FIG. 5 depicts a schematic cross-sectional view of yet another exemplary microwave energy interactive insulating material that may be used to form a construct in accordance with various aspects of the present invention.

FIG. 5 illustrates yet another exemplary insulating material 500 that may be suitable for use with the invention. In this example, the insulating material 500 includes a pair of adjoined, symmetrical layer arrangements. If desired, the two symmetrical arrangements may be formed by folding one layer arrangement onto itself. The first symmetrical layer arrangement, beginning at the top of the drawing, comprises a polymer film layer 502, a susceptor layer 504, an adhesive layer 506, and a paper or paperboard layer 508. The adhesive layer 506 joins the polymer film 502 and the susceptor layer 504 to the paperboard layer 508. The second symmetrical layer arrangement, beginning at the bottom of the drawing, also comprises a polymer film layer 510, a susceptor layer 512, an adhesive layer 514, and a paper or paperboard layer 516. A patterned adhesive layer 518 is provided between the two paper layers 508 and 516, and defines a pattern of closed cells 520 configured to expand when exposed to microwave energy.

By using an insulating material 500 having one susceptor 504 and 512 on each side of the expandable insulating cells 520, more heat is generated, thereby achieving greater expansion of the cells 520. As a result, such a material is able to conform more closely to the contours of a food item than an insulating material having a single susceptor layer, thereby potentially enhancing the heating, browning, crisping, and insulating properties of the construct.

It will be recognized that each of the exemplary insulating materials depicted in FIGS. 3A-5 include a moisture-containing layer (e.g. paper) that is believed to release at least a portion of the vapor that inflates the expandable cells. However, it is contemplated that expandable cell insulating structures that inflate without such moisture-containing layers also may be used in accordance with the invention.

Figure 6A:
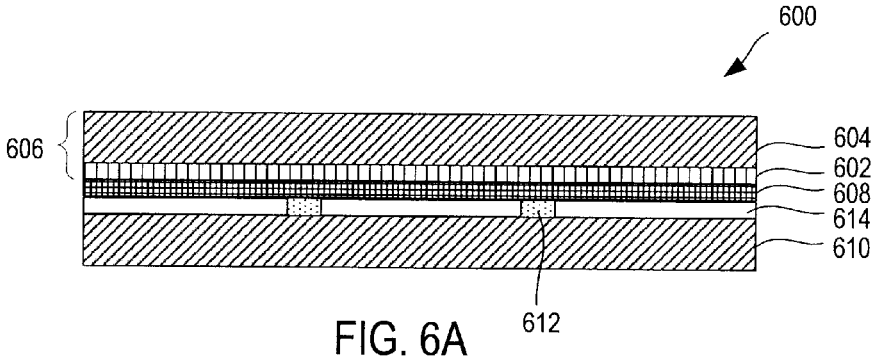
FIG. 6A depicts a schematic cross-sectional view of still another exemplary microwave energy interactive insulating material that may be used to form a construct in accordance with various aspects of the present invention.
Figure 6B:
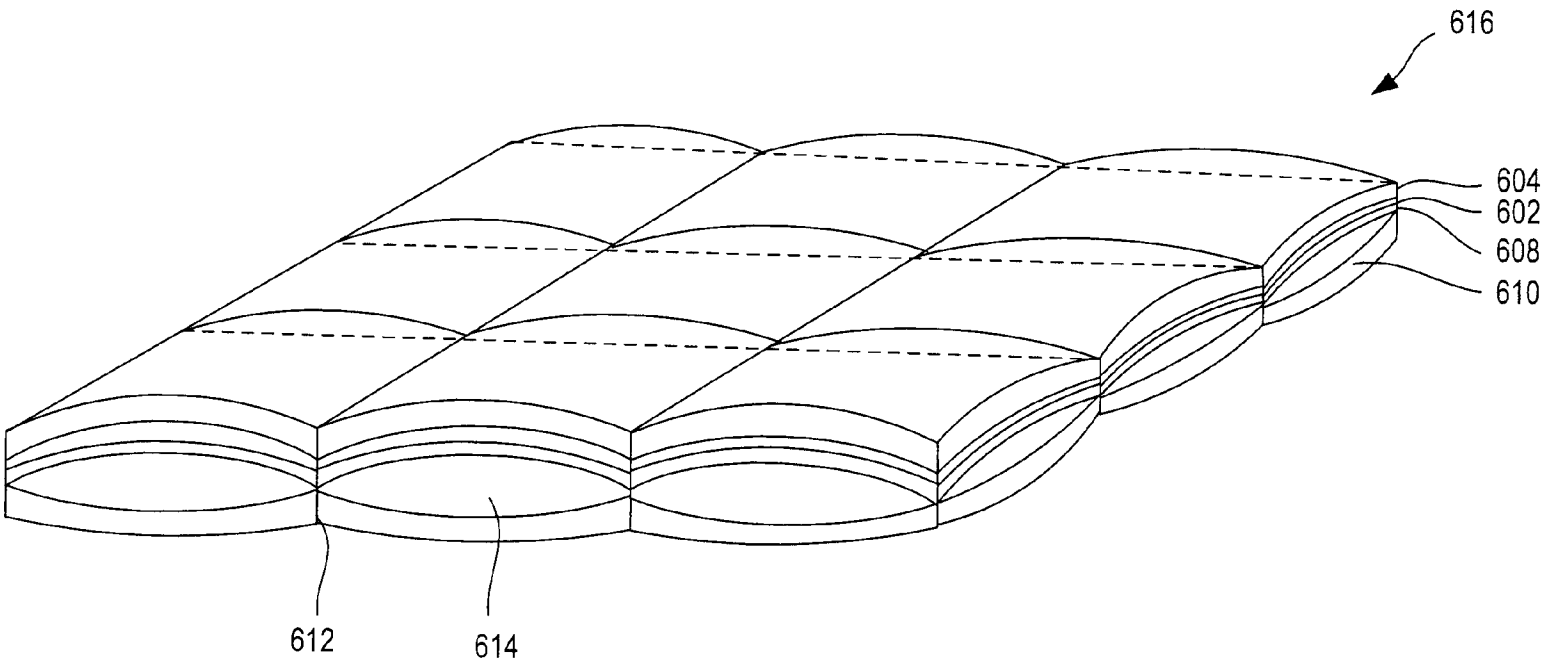
FIG. 6B depicts the exemplary microwave energy interactive insulating sheet of FIG. 6A, upon exposure to microwave energy.

FIG. 6A illustrates one example of an expandable cell insulating material 600 that inflates without the use of a moisture-containing layer, for example, paper. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis (benzenesulphonylhydrazide), azodicarbonamide, and p-toluenesulfonylsemicarbazide. However, it will be understood that numerous other gas-generating reagents and released gases are contemplated hereby.

In the example shown in FIG. 6A, a thin layer of microwave interactive material 602 is supported on a first polymer film 604 to form a susceptor film 606. One or more reagents 608, optionally within a coating, lie adjacent at least a portion of the layer of microwave interactive material 602. The reagent 608 coated susceptor film 606 is joined to a second polymer film 610 using a patterned adhesive 612 or other material, or using thermal bonding, ultrasonic bonding, or any other suitable technique, such that closed cells 614 (shown as a void) are formed in the material 600. The microwave energy insulating material 600 may be cut into a sheet 616 (shown expanded in FIG. 6B) and used to form a construct according to the invention.

As discussed in connection with the other exemplary insulating materials, as the microwave interactive material 602 heats upon impingement by microwave energy, water vapor or other gases are released from or generated by the reagent 608. The resulting gas applies pressure on the susceptor film 606 on one side and the second polymer film 610 on the other side of the closed cells 614. Each side of the material 600 reacts simultaneously, but uniquely, to the heating and vapor expansion to form a pillowed or quilted insulating material 616. This expansion may occur within 1 to 15 seconds in an energized microwave oven, and in some instances, may occur within 2 to 10 seconds. Even without a paper or paperboard layer, the gases released from or generated by the reagent is sufficient both to inflate the expandable cells and to absorb any excess heat from the microwave energy interactive material. Additional examples of "paperless" insulating materials are provided in U.S. Patent Application Publication No. 2006/0289521A1, which is incorporated by reference herein in its entirety.

Typically, when microwave heating has ceased, the cells or quilts may deflate and return to a somewhat flattened state. However, if desired, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion or number of the plurality of cells remain substantially expanded for at least about 1 minute after exposure to microwave energy has ceased. In another aspect, a substantial portion or number of the plurality of cells remain substantially expanded for at least about 5 minutes after exposure to microwave energy has ceased. In still another aspect, a substantial portion or number of the plurality of cells remain substantially expanded for at least about 10 minutes after exposure to microwave energy has ceased. In yet another aspect, a substantial portion or number of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a package or construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a package or construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymer films, that substantially reduce or prevent the transmission of oxygen, water vapor, or other gases from the expanded cells. Examples of such materials are described below. However, the use of other materials is contemplated hereby.

It will be understood that any of the microwave energy interactive insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials may be used to enhance the insulating properties of the construct and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In other examples, multiple sheets of various insulating materials are superposed in any other configuration as needed or desired for a particular application.

The degree of joining or bonding of the multiple layers may vary for a given application. For example, if the greatest degree of loft is desirable, it might be beneficial to use a discontinuous, patterned adhesive bond that will not restrict the expansion and flexing of the layers within the material. As another example, where structural stability is desirable, a continuous adhesive bond might provide the desired result.

Numerous materials or components may be suitable for use in forming the various materials and structures used in the constructs of the invention.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively still, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive structure, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The various constructs of the invention also may include one or more a dimensionally stable, moisture-containing, microwave energy transparent layers. For example, the constructs may include a paper or paper-based material generally having a basis weight of from about 15 to about 60 lbs/ream (lbs/3000 sq. ft.), for example, from about 20 to about 40 lbs/ream. In one particular example, the paper has a basis weight of about 25 lbs/ream. Where a somewhat less flexible heating sheet is desired, the heating sheet or other structures may include a paperboard material generally having a basis weight of from about 60 to about 330 lbs/ream, for example, from about 80 to about 140 lbs/ream, or from about 100 to about 150 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

If desired, any of the various constructs of the invention may include one or more discontinuities or microwave energy transparent or inactive regions to prevent overheating or charring of the heating sheet, dimensionally stable disk, tray, or any other component proximate the heating sheet during the heating cycle. The inactive regions may be designed to be microwave inactive, for example, by forming these areas without a microwave energy interactive material, by removing microwave energy interactive material from these areas, or by deactivating the microwave energy interactive material in these areas.

Further still, one or more panels, portions of panels, or portions of the construct may be designed to be microwave energy transparent to ensure that the microwave energy is focused efficiently on the areas to be browned and/or crisped, rather than being lost to portions of the food item not intended to be browned and/or crisped or to the heating environment. For example, the peripheral edges of the construct or other areas not expected to be in contact with the food item (e.g., one or more of bonded areas 112, 114, 116, 216, 220) may not include a microwave energy interactive material, or may include a microwave energy interactive material that has been deactivated.

It will be understood that with some combinations of elements and materials, the microwave interactive material or element may have a grey or silver color this is visually distinguishable from the substrate or the other components in the structure. However, in some instances, it may be desirable to provide a structure having a uniform color and/or appearance. Such a structure may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the structure with a silver or grey ink or other concealing color in a suitable pattern or as a solid color layer to mask or conceal the presence of the microwave interactive element, or any other suitable technique or combination thereof.

Although specific examples are illustrated herein, the various constructs of the invention may have any shape, for example, triangular, square, rectangular, circular, oval, pentagonal, hexagonal, octagonal, or any other shape. The shape of the construct may be determined by the shape and portion size of the food item or items being heated, and it should be understood that different packages are contemplated for different food items and combinations of food items, for example, dough-based food items, breaded food items, sandwiches, pizzas, French fries, soft pretzels, chicken nuggets or strips, fried chicken, pizza bites, cheese sticks, pastries, doughs, egg rolls, soups, dipping sauces, gravy, vegetables, and so forth.

It also will be understood that in this and other aspects of the invention, one or more different food items may be placed into the various compartments for heating, browning, and/or crisping of thereof. As such, the various compartments may have the same dimensions, different dimensions, and may be formed from the same materials or different materials. In one example, a construct for heating, browning, and/or crisping a plurality of food items includes at least two compartments, one for a sandwich and one for French fries. In other examples, various constructs may be formed to heat, brown, and/or crisp a sausage biscuit and hash browns; eggs and bacon; grilled cheese and potato "tots"; French toast and sausage; chicken strips and biscuits; egg rolls and potstickers; pot pie and fruit cobbler; or one or more servings of any sweet or savory food item, or any combination thereof.

If desired, any of such food items may be provided within the sleeve, pouch, or other construct, which optionally may be sealed. Alternatively, any of such food items may accompany the sleeve, pouch, or other construct within one or more other packages or overwraps.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention. While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention as set forth in the appended claims.

What is claimed is:

1. A microwave heating construct, comprising:

a plurality of panels comprising a first panel foldably connected to a second panel along a first fold line, a third panel foldably connected to the second panel along a second fold line, and a fourth panel foldably connected to the third panel along a third fold line, the plurality of panels comprising a microwave energy interactive material operative for generating heat in response to microwave energy;

a first compartment comprising the first panel and the second panel, wherein the first panel and the second panel are folded along the first fold line to be disposed generally opposite to one another; and a second compartment comprising the third panel and the fourth panel, wherein the third panel and the fourth panel are folded along the third fold line to be disposed generally opposite to one another, the first compartment being foldably connected to the second compartment along the second fold line;

wherein the first compartment and the second compartment are side by side in a first configuration, and the first compartment overlies the second compartment in a second configuration.

2. The construct of claim 1, wherein each of the first compartment and the second compartment comprises an open end.

3. The construct of claim 1, wherein the first panel and the third panel are at least partially secured to the respective second panel and fourth panel along a bond area extending along to the second fold line.

4. The construct of claim 3, wherein the first panel comprises a first edge and the second panel comprises a second edge, and the first edge and the second edge are disposed proximate the second fold line in the bond area.

5. The construct of claim 3, wherein the bond area is a first bond area, and the first panel and the third panel are at least partially secured to the respective second panel and fourth panel along a second bond area extending along a closed end of the first compartment and the second compartment.

6. The construct of claim 5, wherein the second bond area at least partially intersects an end of the first bond area.

7. The construct of claim 5, wherein the second bond area extends from the first fold line to the third fold line.

* * * * *